United States Patent [19]

Rogers

[11] Patent Number: 4,694,980

[45] Date of Patent: Sep. 22, 1987

[54] HANDGUN HOLSTER

[75] Inventor: William H. Rogers, Jacksonville, Fla.

[73] Assignee: Safariland Ltd., Inc., Monrovia, Calif.

[21] Appl. No.: 827,816

[22] Filed: Feb. 10, 1986

Related U.S. Application Data

[63] Continuation-in-part of Ser. No. 730,050, May 3, 1985, abandoned.

[51] Int. Cl.[4] ..... F41C 33/02

[52] U.S. Cl. ..... 224/243; 224/238; 224/911

[58] Field of Search ..... 224/911, 238, 237, 198, 224/243, 192

[56] References Cited

U.S. PATENT DOCUMENTS

| | | | |
|---|---|---|---|
| 1,696,708 | 12/1928 | Brauer | 224/911 X |
| 2,970,727 | 2/1961 | Bohlin | 224/911 X |
| 3,011,687 | 12/1961 | Boyt | 224/911 X |
| 3,252,638 | 5/1966 | Rolston et al. | 224/911 X |
| 3,420,420 | 1/1969 | Clark | 224/243 |
| 3,630,420 | 12/1971 | Bianchi | 224/243 X |
| 3,645,428 | 2/1972 | Angell | 224/911 X |
| 4,094,450 | 1/1978 | Parlante et al. | 224/243 |
| 4,101,060 | 7/1978 | Bianchi et al. | 224/243 X |
| 4,143,798 | 3/1979 | Perkins | 224/243 |
| 4,273,276 | 6/1981 | Perkins | 224/243 |
| 4,286,741 | 9/1981 | Rogers | 224/911 X |
| 4,298,150 | 11/1981 | Seldeen | 224/243 |
| 4,312,466 | 1/1982 | Clark | 224/243 |
| 4,325,506 | 4/1982 | Lindell et al. | 224/911 X |
| 4,542,841 | 9/1985 | Bianchi et al. | 224/243 X |

*Primary Examiner*—Stephen Marcus
*Assistant Examiner*—Robert M. Petrik
*Attorney, Agent, or Firm*—Arthur G. Yeager

[57] ABSTRACT

A molded handgun holster having rigid inner and outer spaced sidewalls joined together along the front and lower back portions to define an inner expandable cavity with an open expandable top, the improvement including two separate handgun securing straps with tabs for unlocking those straps concealed by portions of the weapon, but releaseable simultaneously by the wearer while grasping the handle of the handgun; one strap having a thumb engaging releaseable fastener and adapted to press the handgun downwardly in the holster; and the other strap having a middle finger engaging releaseable fastener and adapted to prevent the inner cavity and open top from expanding when fastened but permitting a limited expansion of both when unfastened; and a molded ledge on the inside of the holster to engage an edge of the handgun when the inner cavity is not expanded.

15 Claims, 13 Drawing Figures

HANDGUN HOLSTER

RELATED APPLICATIONS

This is a continuation-in-part of copending patent application Ser. No. 730,050 filed May 3, 1985 now abandoned.

BACKGROUND OF THE INVENTION

This invention generally relates to handgun holsters and more particularly concerns a holster with improved features to prevent inadvertent withdrawal of the handgun from the holster. The holster is designed to retain the handgun securely and yet to permit rapid withdrawal when required.

In recent years it has become apparent that most attacks on police officers by assailants trying to remove an officer's handgun from the holster have come from the front or side of the officer and not from the rear, as previously thought. It is obvious that an assailant has more mechanical leverage as well as an unobstructed path by simply pulling forward and up on the handle of the weapon while standing in front facing the officer or facing him at his side. Holsters as typified by U.S. Pat. Nos. 3,630,420; 4,542,841; 4,273,276; and applicant's own U.S. Pat. Nos. 3,902,639 and 4,286,741; attempt to make it difficult for an assailant to remove an officer's handgun from the rear. They have not, however, addressed the more important problem of protection against an attack from someone facing the officer. As a matter of fact, in the above cited patented holsters, once the securing strap is unlocked, it is significantly easier for an assailant facing an officer to remove the weapon from the holster than it is for the officer himself to draw that same weapon. In most of these holsters a violent pull of the weapon from the front will stress the securing straps to cause release by shearing or simply unsnapping. As pointed out in U.S. Pat. No. 4,542,841 the handgun is drawn by a forward-upward motion; which is the natural direction for an assailant facing an officer and pulling on the handgun. It should also be noted that it is readily apparent even to an untrained person, how to unlock the securing strap on these prior art holsters. A single securing strap is employed to allow the officer to unlock his holster with a single motion. Additional separate securing straps or devices have not been employed because of the additional delay entailed in drawing the weapon. General tradition has dictated the design of the release strap such that the officer releases the strap with his thumb as he begins the drawing motion. This places the release mechanism at the top or top front of the holster which is not only visually obvious but easily accessible to an attacker facing the officer.

It has been expected that the securing strap of the holster might become unlocked in a violent attack. Because of this possibility, an internal locking method is incorporated in some of the prior art holsters so that the handgun will not fall out inadvertently from the holster when unlocked, and also to make it more difficult for the attacker to remove the handgun from the holster in an attack from the rear of the officer. Generally, the internal locking means engages the back recurve of the trigger guard or the top ledge caused by the cylinder of a revolver. In more recent times the popularity of the semiauto pistol, has posed a problem in the design of a secure holster, because this type of handgun has no cylinder ledges nor trigger guard recurves to serve as a locking point. An attempt to lock upon the forward portion or the trigger guard is not preferred because only a few models of semi-automatics offer a flat ledge at the forward portion of the trigger guard necessary for the locking action. Also common modifications to the front of the trigger guard, such as checkering or stippling, make such a locking locations inoperative.

It is believed that neither a front opening nor a rear opening holster affords the necessary security to the holstered handgun, if the retaining strap is unlocked. A total enclosed top opening holster provides better security from a force straight forward or rearward, but the design of the present top opening holsters does not offer any internal locking device which can be easily unlocked by the trained officer as part of the drawing motion.

It is an object of this invention to provide a handgun holster which overcomes the deficiencies of the prior art, and is designed to provide a holster which secures the handgun from withdrawal by any but the wearer and yet permits a fast withdrawal upwardly by one trained in using the holster. It is another object to provide a holster that provides obstacles to one attempting an unauthorized withdrawal of the handgun from the front or side of the holster. Other objects will appear in the more detailed description which follows.

BRIEF SUMMARY OF THE INVENTION

This invention relates to an improved handgun holster having, with respect to the wearer of the holster, inner and outer spaced substantially rigid sidewalls joined together along the forward and lower rear portions thereof to define an inner expandable cavity and an open expandable top for receiving the handgun therein and for removing the handgun therefrom; the improvement comprising a first strap portion extending upwardly from adjacent the forward portion of the outer sidewall and attached by a releasable fastener to a second strap portion extending upwardly from adjacent the forward portion of the inner sidewall and including a thumb engaging tab adjacent the fastener; a third strap extending laterally across and affixed to the outside of both the outer and inner sidewalls adjacent the open top, a releasable fastener joining ends of the lateral strap adjacent the rear portion of the inner sidewall with a middle finger engaging tab on the strap adjacent the fastener, said third strap having one end attached to the inner sidewall by a slideable means adapted to permit limited expansion of the open top and of the inner cavity when the releasable fastener of said lateral strap is open and a means in said inner cavity to engage a portion of the handgun in the holster to resist upward withdrawal of the handgun.

In preferred embodiments of this invention the thumb and middle finger engaging tabs are adjacent to snap fasteners and are substantially concealed by portions of the holstered handgun and are not readily accessible to one not wearing the holster, although they are easily released by the wearer in a single movement to grasp the handgun handle. The holster is molded with an internal ledge to engage the ejection port of semi-automatic pistols or the cylinder edge of revolvers to prevent upward movement of the handgun until both the securing straps have been released and the butt of the handgun rotated rearwardly to expand the inner cavity and the open top of the holster to the extent of the lateral strap. Tha main purpose of the limited expansion of the lateral strap is to prevent the handgun from being pulled through the rear of the expanded inner cavity.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
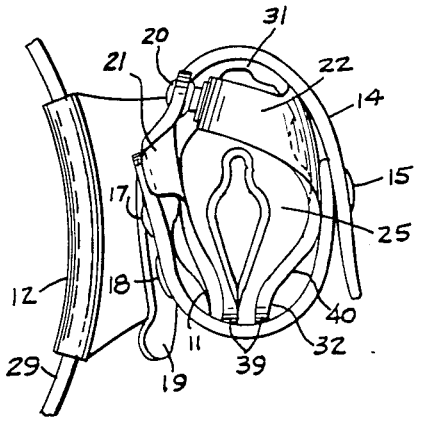
FIG. 1 is a top plan view of the holster of this invention.
Figure 3:
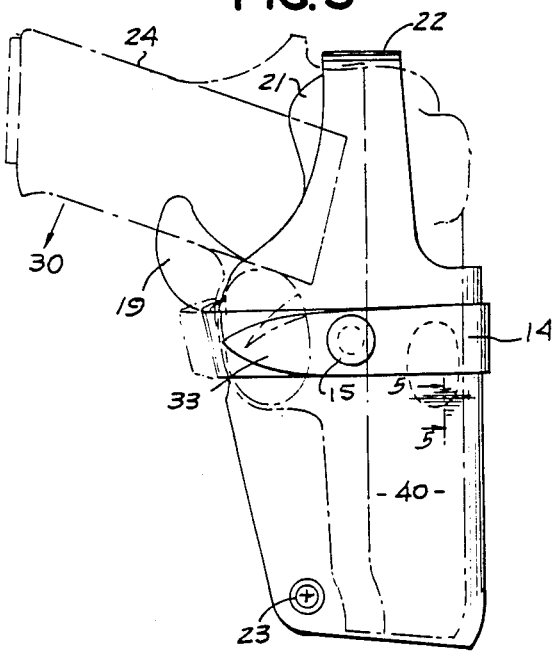
FIG. 3 is an outside elevational view of the holster of this invention employed with a semi-automatic pistol.
Figure 2:
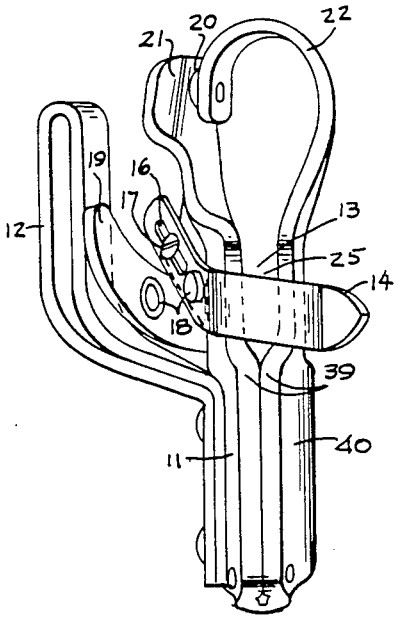
FIG. 2 is a rear elevational view of the holster of this invention.
Figure 4:
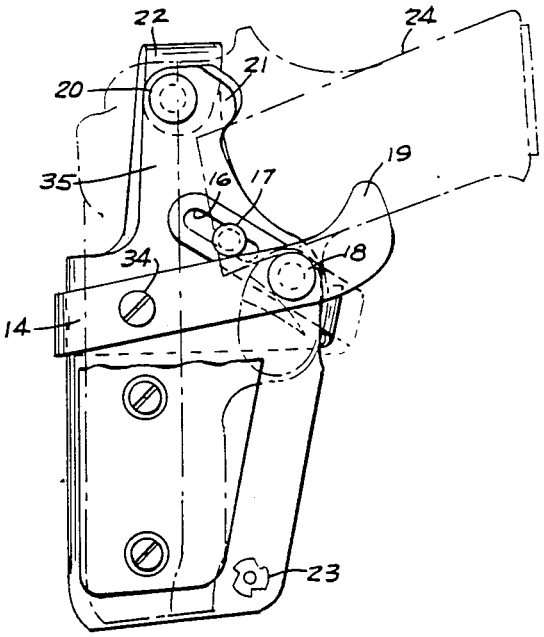
FIG. 4 is an outside elevational view of the holster of this invention employed with a semi-automatic pistol.

The accompanying drawings of FIGS. 1–5 show the general and special features of the holster of this invention used with a semi-automatic pistol. The holster as viewed by the wearer of the holster, has an outer sidewall 40 and an inner siedwall 11 joined together along the respective forward portions 31 and lower rear portions 32. Preferably, sidewalls 40 and 11 are formed by folding a single piece of material along front portion 31 and fastening the back portions together at the lower corner 23 by stitching, rivet, or the like. The two sidewalls are spaced apart along open top 13 to form an inner cavity 25 that encloses and retains a pistol 24 (shown in dotted lines). The holster preferably is made of a laminate of an outside layer of leather and an inside layer of plastic, with the laminate being thermally molded to fit a particular handgun, in this case a semi-automatic pistol. In some instances, the laminate has only two layers, while in others there may be three layers comprising outer and inner leather layers with a central plastic layer sandwiched between the two leather layers. Since each type and model of handgun is unique, each holster will be slightly different in inside contours although the features of this invention will be present in each holster. A preferred method of manufacture of these holsters is that described and claimed in my U.S. Pat. No. 4,340,437 which issued July 20, 1982.

The holster of this invention may be made for carrying wherever the wearer desires; i.e., under the arm, on the leg, on a waist belt, or the like. In the drawings there is shown a molded belt loop 12 attached to the holster and through which a belt 29 may be threaded. It is to be understood, however, that any other type of carrying attachment may be substituted for belt loop 12, even though the features of this holster are particularly advantageous for holsters carried on a waist belt.

One of the safety restraining features of this invention is in lateral strap 14 and its component parts. Strap 14 encircles and is affixed to both inner and outer sidewalls 11 and 40 adjacent open top 13. Strap 14 is affixed to outer sidewall 40 by fastener 15 which is made to appear to be a snap fastener as evidenced by fastener head 15 and flap 33. The purpose of this false snap fastener is twofold; firstly, it provides a neat appearance, and secondly, it may deceive one who surreptitiously attempts to withdraw the handgun and thinks strap 14 must first be unsnapped at 15, thus giving the one wearing the handgun an opportunity to defend himself.

The purpose of strap 14 is to keep the open top 13 closed snugly around the holstered handgun until it is time to withdraw the handgun. When strap 14 is loosened, it permits open top 13 and interior cavity 25 to expand so the handgun may be withdrawn. It is important, however, for strap 14 to be limited in its loosening movement so that the handgun can never be withdrawn from the rear, but must always be withdrawn upwardly. Strap 14 is affixed to outer wall 40 by fastener 15 and to inner wall 11 by fastener 34 which may be a rivet, a screw, or the like. Strap 14 has two ends, 41 and 42, which cross each other near rear portion 32 of inner sidewall 11 and are fastened to each other by a releasable fastener 18, preferably a snap fastener. End 42 overlies end 41 and includes tab 19 that is adapted to be engaged by the middle finger of the hand withdrawing the handgun. Pressure by the middle finger toward belt loop 12 will unsnap fastener 18. To serve this purpose, tab 19 must be reasonably rigid and this is easily accomplished when using a laminate of leather and plastic for the material of the holster. End 41 of strap 14 is slideably attached to inner sidewall 11 so as to permit a limited loosening of open top 13 and expanding of interior cavity 25 when fastener 18 is open. This slideable arrangement also facilitates realignment of the fastener 18 components when securing the gun in the holster. The manner shown here for providing the sliding engagement is a screw or pin 17 with a wide head and with its shank affixed to sidewall 11 and a slot 16 in strap 14 to slide on the shank of screw or pin 17. When fastener 18 is opened, strap 14 will automatically slide along slot 16 to permit spreading of sidewalls 40 and 11 for ease in withdrawing the handgun from the holster. The limits of slot 16 do not permit enough slack in strap 14 for handgun 24 to be withdrawn from the rear of the holster.

Another retaining safety feature is the combination of strap portion 22 and cooperating strap portion 35. Strap portion 22 extends upwardly from forward portion 31 of outer sidewall 40 and loops over the holstered handgun to meet a similar upwardly extending strap portion 35 from forward portion 31 of inner sidewall 11 at releasable fastener 20, preferably a snap fastener. Extending rearwardly from fastener 20 is a tab 21 which is adapted to be engaged by the thumb of the hand withdrawing the handgun from the holster. Tab 21, like tab 19, is made to be reasonably rigid so that pressure by the thumb toward belt loop 12 will open snap fastener 20.

Figure 5:
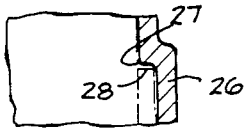
FIG. 5 is across section taken at 5—5 of FIG. 2.
Figure 6:
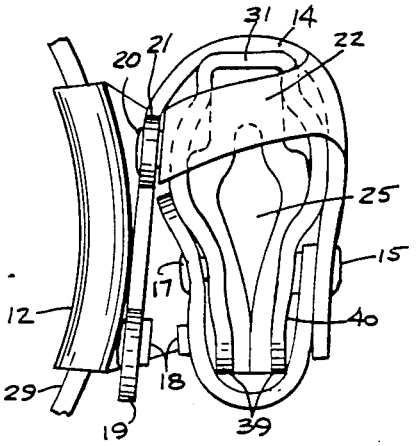
FIG. 6 is a top plan view of an alternate embodiment of the holster of this invention.
Figure 8:
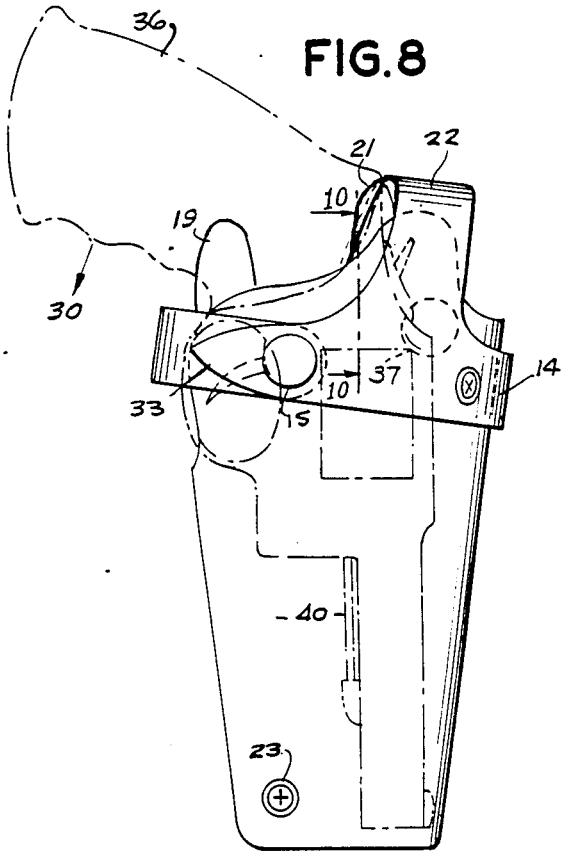
FIG. 8 is an outside elevational view of the holster of FIG. 6 employed with a revolver.
Figure 7:
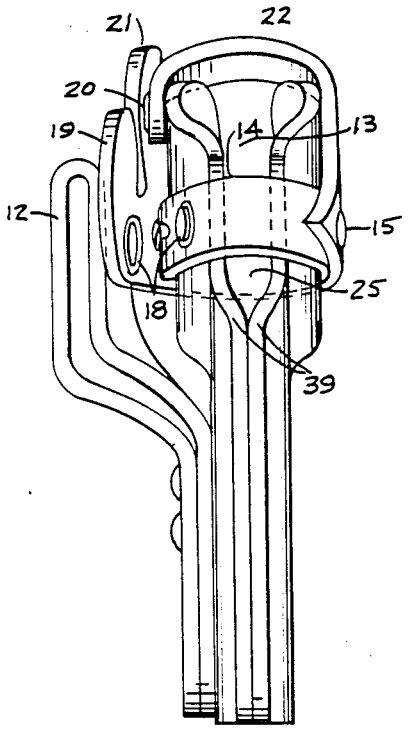
FIG. 7 is arear elevational view of the holster of FIG. 6.
Figure 9:
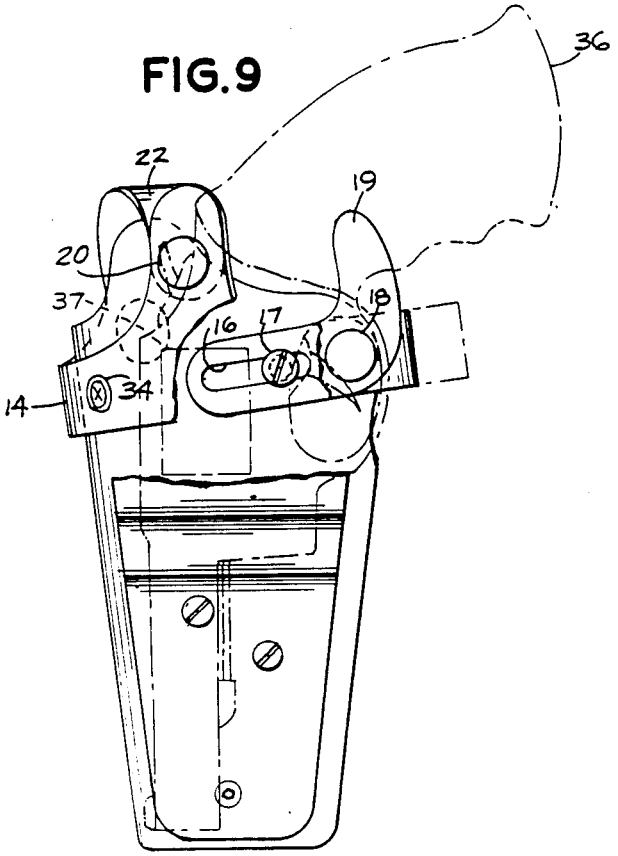
FIG. 9 is an inside elevational view of the holster of FIG. 6 employed with a revolver.
Figure 10:
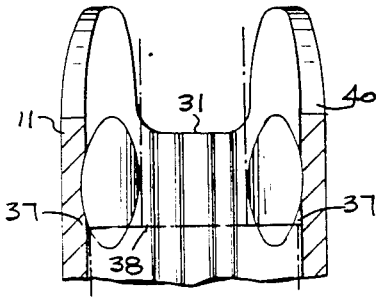
FIG. 10 is across section taken at 10—10 of FIG. 8.

The third safety feature of the holster of this invention is a lateral projection, preferably a molded ledge, on the inside surface of sidewall 40 or sidewall 11 or both, which will engage a corresponding edge or recess of the handgun when fully inserted into the holster. In FIG. 5 there is shown such a ledge 27 molded into a portion 26 of outer sidewall 10 in the inner cavity 25 to engage an edge 28 of the pistol, preferably the cartridge ejection port. Ledge 27 does not extend very far in a lateral direction, and this is to permit the handgun to be easily withdrawn if the butt of the handgun is first rotated slightly in the direction of arrow 30. Rear edges 39 of walls 40 and 11 are fastened together only by rivet 23 and will spread apart near top opening 13 when handgun 24 is rotated in the direction of arrow 30. Once again, this is for the purpose of preventing an inadvertent or unintentional withdrawal of the weapon. When fastener 18 is open, strap 14 is loosened slightly and permits the butt of handgun 24 to be moved just enough for edge 28 to clear ledge 27, and then the handgun can be withdrawn upwardly through open top 13. Strap 14 prevents an assailant from trying to pull handgun 24 to the rear and remove it from the holster.

In FIGS. 6–10 there is shown an alternative embodiment of the holster of this invention employed with a revolver. The general features and components of this holster are the same as those of the holster in FIGS. 1–5 although shapes and sizes are modified to fit the revolver rather than the semi-automatic pistol.

Outer wall 40 and inner wall are shaped to define an interior cavity 25 to fit the revolver as shown in dotted lines at 36. The walls 40 and 11 are preferably one piece folded in front at 31 and fastened together at the lower rear corner 23 by a rivet. A lateral strap 14 encircles the holster adjacent open top 13 and is affixed to outer wall 40 by snap fastener 15 and to inner wall 11 by fastener 34. Strap 14 has a slideable attachment to inner wall 11 embodying slot 16 and screw 17. The two ends of strap 14 are joined together by snap fastener 18 with finger engaging tab 19 as an extension above fastener 18. Strap 22 extends over the top of the holstered revolver to a snap fastener 20 and a finger engaging tab 21 on the inner side of the holster adjacent front portion 31. In this embodiment strap 22 is a lateral extension of strap 14 rather than of outer wall 40. Similarly, fastener 20 and tab 21 are on a lateral extension of strap 14 rather than an extension of inner wall 11. Since strap 14 is permanently affixed to outer wall 40 and to inner wall 11 adjacent front portion 31 it is optional to attach strap 22, fastener 20 and tab 21 to strap 14 or to walls 40 or 11.

Interior ledges 37 are fashioned to catch the edges of the cylinder 38 of revolver 36 and prevent upward withdrawal of the revolver from the holster until the butt is rotated downward and rearward in the direction of arrow 30 to permit the edges of cylinder 38 to clear ledges 37. Rear edges 39 of walls 40 and 11 are held together by rivet 23 and the molded shape of the holster until revolver 36 is moved in the direction of arrow 30 to cause edges 39 to spring apart near top opening 13.

Figure 11:
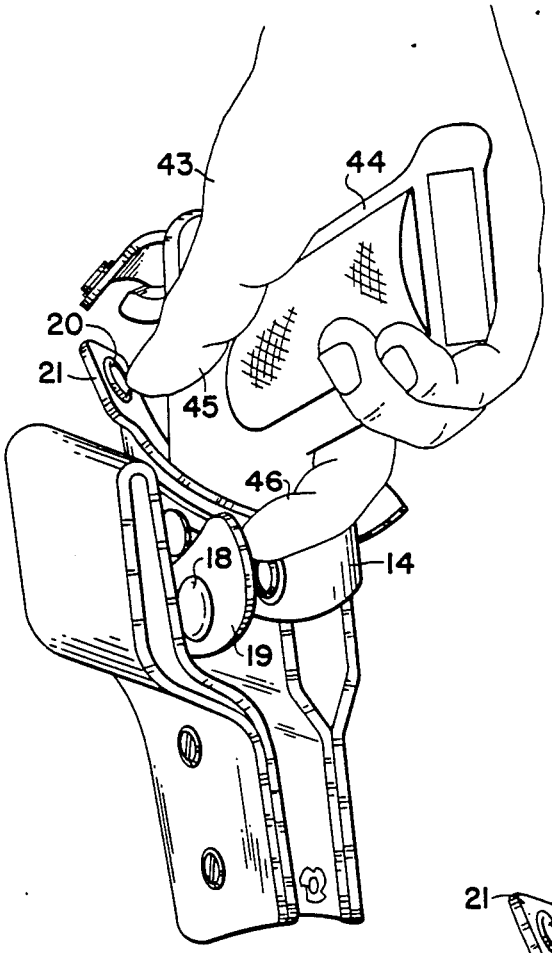
FIG. 11 is a schematic representation of the first step in withdrawing a handgun from the holster of this invention.
Figure 12:
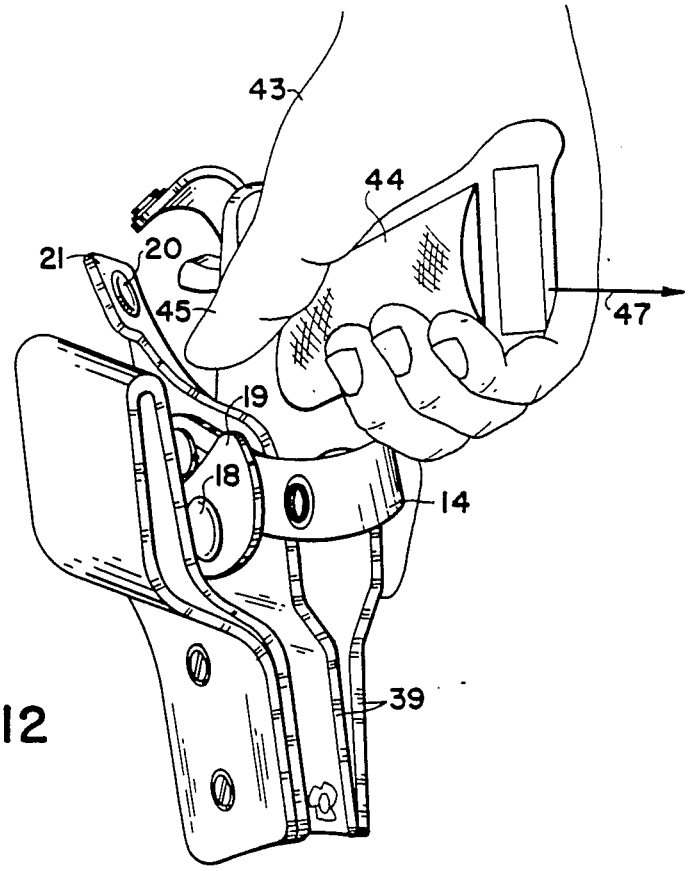
FIG. 12 is a schematic representation of the next step following that of FIG. 11.
Figure 13:
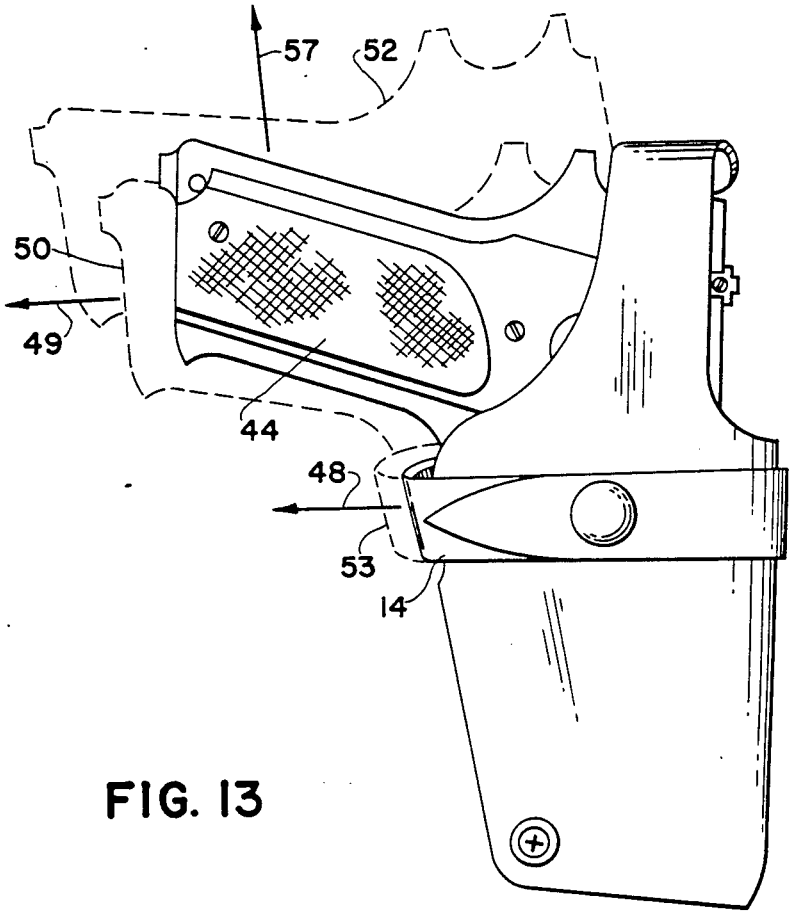
FIG. 13 is a schematic illustration of the movements required to release the handgun from the holster.

In FIGS. 11–13 there are shown the steps of withdrawing the handgun from the holster. These illustrated steps are identical regardless whether the handgun is a semi-automatic or a revolver, although a semi-automatic is shown in FIGS. 11–13.

In the first step (FIG. 11) the hand 43 grasps the butt 44 of the handgun with thumb 45 pressing against tab 21 and the middle finger 46 pressing against tab 19. These two fingers pushing toward the body of the wearer of the holster cause snaps 20 and 18 to be unsnapped. In the second step (FIG. 12) butt 44 is pulled backward in the direction of arrow 47 causing rear edges 39 to spread apart to open interior cavity sufficiently to loosen the handgun, and also to release the handgun from ledge 27 (see FIG. 5). The unsnapping of fastener 18 releases strap 14 permitting it to slide with respect to slot 16 and pin 17, which, in turn, permits butt 44 to be moved backward. In the third step the handgun is withdrawn upwardly from the holster. The movements of the handgun are shown in FIG. 13. Unsnapping of fasteners 18 and 20 releases for movement. Strap 14 is released by unsnapping fastener 18 allowing strap 14 to expand in the direction of arrow 48 taking the general position shown at 53 in dotted lines. Butt 44 can then be moved backward in the direction of arrow 49 to the position 50 in dotted lines. This movement is sufficient to release the handgun from ledge 27 inside the holster permitting the handgun to be withdrawn upwardly in the direction of arrow 51 to position 52 in dotted lines and on to complete withdrawal from the holster.

All of the three safety features are easily manipulated by the one wearing the holster and knowing what must be done to withdraw the handgun, but one or more of them might foil the withdrawal by one not knowing of these features. Furthermore, sudden and/or violent body movements, e.g., caused by a physical struggle with an opponent, might cause the holster to loosen and the handgun to fall out of the holster if it did not have these features.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. In a holster for a handgun and attachable to a belt, the holster having with respect to a front and back of a wearer of the holster inner and outer spaced substantially rigid sidewalls joined together along the forward and lower rear portions thereof to define an inner expandable cavity and an open expandable top and upper rear portions for receiving a handgun therein and for removing a handgun therefrom, the improvement comprsing a first strap portion extending upwardly from adjacent said forward portion of said outer sidewall and attached by a releasable first fastener to a second strap portion extending upwardly from adjacent said forward portion of said inner sidewall and including a thumb engaging first tab adjacent said first fastener; a third elongated strap extending laterally across and affixed to said outer and inner sidewalls adjacent said open expandable top, and upper rear portions, a releasable second fastener joining ends of said third strap adjacent a rear portion of said inner sidewall with a middle finger engaging second tab on said third strap adjacent said second fastener, slideable means attaching one end of said third strap to said inner sidewall for limited expansion of said open expandable top and upper rear portions and of said inner cavity when said second fastener is opened by a middle finger engaging said second tab and a thumb engages said first tab to open said first fastener, and means in said inner cavity to engage a portion of a handgun in the holster to resist upward withdrawing of a handgun.

2. The handgun of claim 1 wherein said second tab is located on a portion of said second strap extending rearwardly of and adjacent said second fastener.

3. The holster of claim 1 wherein each of said first and second fasteners is a snap fastener.

4. The holster of claim 1 wherein said third strap includes a first and a second end portion, said first end portion being wrapped around said upper portions of said inner and outer sidewalls, said slideable means including a lengthwise slot in said third strap first end portion and a pin affixed to said inner sidewall slideably engaged with said slot in said third strap, said second end portion being wrapped around the forward portions of said sidewalls adjacent said open top and overlapping said first end portion between said pin and said upper rear portion of said inner sidewall, said second fastener connecting said first end portion to said second end portion generally at the arear of overlapping, said second end portion terminating in said second tab projecting upwardly and rearwardly from said second fastener and adapted to permit unobstructed middle finger engagement thereof.

5. The holster of claim 1 wherein said means to engage a handgun includes a small lateral ledge adapted to engage a shoulder of a handgun when fully inserted into the holster, said ledge when engaged with a shoulder providing resistance to upward withdrawal of a handgun until a butt of a handgun is rotated rearwardly and downwardly.

6. The holster of claim 1 wherein said first strap portion extends upwardly from said outer sidewall and over a handgun, said first strap portion preventing handgun withdrawal until said first fastener joining said first and second strap portions is opened.

7. The holster of claim 1 which is formed from a thermally molded stiff laminate of an outside layer of leather and an inside layer of plastic and wherein said means in said inner cavity is formed of said plastic inside layer.

8. The holster of claim 1 molded such that said inner cavity generally fits the outside contour of a semi-automatic pistol, means in said inner cavity engaging a cartridge ejection port of a semi-automatic pistol.

9. The holster of claim 1 molded such that said inner cavity generally fits the outside contour of a revolver, said means in said inner cavity engaging an edge of a cylinder of a revolver.

10. A stiff, molded handgun having restraining means which make it difficult for a handgun to be withdrawn inadvertently from the holster, said holster having with respect to a front and back of a wearer of the holster inner and outer sidewalls, each sidewall having forward and lower rear portions joined together to define an expandable open top and upper rear portions and an expandable inner cavity, and a loop for attaching said holster to a belt of a wearer; said restraining means including an elongated lateral closure strap around the holster adjacent said open top and having a first tab adjacent to a first releasable snap fastener adapted to be opened by pressing said tab with a middle finger of a wearer to loosen said lateral strap, a pair of keeper strap portions lying over a handgun and joined respectively to said inner and outer sidewalls at forward portions thereof adjacent said open top and having a thumb engagable second tab adjacent to a second releasable snap fastener joining said pair of strap portions and adapted to be opened by thumb pressure on said tab, and a ledge means projecting into said inner cavity engage to a portion of a handgun to prevent upward withdrawal of a handgun until a butt of a handgun is rotated toward said upper rear portions sufficiently to clear said ledge means with said first and second snap fasteners being opened.

11. The holster of claim 10 wherein said lateral closure strap includes a middle portion and a pair of end portions with said middle portion being affixed to each of said inner and outer sidewalls and said pair of end portions overlapping and releaseably fastened thereat by a snap fastener adjacent a rear portion of said inner sidewall and adjacent said open top portion, one said end portion closer to said inner sidewall being slideable attached portion closer to said inner sidewall and the other of said end portions terminating in said first tab adapted to be engaged by a middle finger rearwardly of said inner and outer sidewalls, said second tab extending upwardly and rearwardly from said first snap fastener.

12. The holster of claim 11 further comprising slideable attachment means between said one end portion and said inner side wall including a pin affixed to said inner sidewall and projecting outwardly therefrom and a slot in said lateral strap one end portion slideably engaged about said pin for limited movement to permit said open top and upper rear portions to be expanded.

13. The holster of claim 10 wherein one of said pair of keeper strap portions is defined by an outer portion extending upwardly from adjacent said forward portion of said outer sidewall and over a handgun and the other of said pair of keeper strap portions being defined by an inner portion extending upwardly from adjacent the forward portion of said inner sidewall, said outer and inner portions being releaseably fastenable to each other by said second snap fastener, and said inner portion carrying said second tab which extends rearwardly from said second snap fastener.

14. The holster of claim 10 wherein said ledge means comprises a small molded lateral ledge projecting into said inner cavity from the inside surface of one of said sidewalls and adapted to engage a corresponding ledge on a handgun insertable into said holster.

15. The holster of claim 10 wherein said first snap fastener is adapted to be opened by pressure of the middle finger of a hand of a wearer withdrawing a handgun from said holster, and said second snap fastener on the keeper strap being adapted to be opened by pressure of a thumb of the same hand of a wearer withdrawing a handgun from said holster, both of said first and second fasteners are opened and a handgun is withdrawable only by subsequent rotation rearwardly of a handgun in said holster by expanding said open top and upper rear portions of said holster and a handgun clearing said ledge means.

* * * * *